United States Patent [19]

Sosebee

[11] Patent Number: 5,031,886

[45] Date of Patent: Jul. 16, 1991

[54] PORTABLE FRAMING AID

[76] Inventor: Robin Sosebee, 1724 Pamela Cir., Marietta, Ga. 30060

[21] Appl. No.: 548,839

[22] Filed: Jul. 6, 1990

[51] Int. Cl.[5] ..... B25B 5/00

[52] U.S. Cl. ..... 269/41; 269/43; 269/910

[58] Field of Search ..... 269/40, 43, 303, 910, 269/41; 100/913; 29/281.1, 281.3; 227/152, 154, 155

[56] References Cited

U.S. PATENT DOCUMENTS

| | | | |
|---|---|---|---|
| 904,823 | 11/1908 | Wellan . | |
| 1,549,671 | 8/1925 | Kridler et al. . | |
| 2,466,919 | 4/1949 | Sykes . | |
| 2,567,586 | 9/1951 | Werder . | |
| 2,749,873 | 6/1956 | Huffman | 269/910 |
| 2,811,186 | 10/1957 | Honza | 269/910 |
| 2,883,764 | 4/1959 | Stephens . | |
| 2,991,857 | 7/1961 | Soderberg . | |
| 3,169,320 | 2/1965 | Currie . | |
| 3,201,874 | 8/1965 | Christy . | |
| 3,629,931 | 12/1971 | Stanley . | |
| 3,933,348 | 1/1976 | Tidwell, Jr. . | |
| 4,322,064 | 3/1982 | Jarvis . | |
| 4,420,921 | 12/1983 | Hardin . | |
| 4,527,337 | 7/1985 | Dreiling . | |
| 4,541,618 | 9/1985 | Bruno | 269/910 |
| 4,575,059 | 3/1986 | Blaine | 269/910 |
| 4,647,027 | 3/1987 | Shafto . | |

*Primary Examiner*—Robert C. Watson

*Attorney, Agent, or Firm*—Thomas, Kerr & Kayden

[57] ABSTRACT

A framing aid for use in the construction of a building comprises an elongated member having formed therein a plurality of transverse grooves for accepting the ends of studs and a longitudinal groove intersecting the transverse grooves for accepting a plate and maintaining it in contact with the ends of the studs for attachment thereto.

1 Claim, 2 Drawing Sheets

PORTABLE FRAMING AID

TECHNICAL FIELD

The present invention relates generally to carpenter's tools and particularly to spacing jigs.

BACKGROUND OF THE INVENTION

There are many instances in the construction of buildings such as houses in which framing members must be accurately spaced to provide proper sizing and strength. This is particularly true of wall sections consisting of spaced vertical studs which are attached at their ends to top and bottom plates. It is common for such wall sections to be constructed on a horizontal surface such as a floor and raised to their vertical position to be attached to the floor or other wall sections. The top and bottom plates are generally carefully measured and marked at the positions where the studs are to attach. Each stud is then manually positioned between the plates, aligned with the proper marks, and attached to the plates with nails. This process is not only time consuming, it also requires the skill of an experienced carpenter and is subject to measurement errors which result in improper stud placement.

Previous attempts to simplify the process of constructing wall sections have not been entirely successful. U.S. Pat. No. 4,527,337 of Dreiling shows a device for marking the top and bottom plates for stud placement. While this device reduces measurment errors, it still requires that each stud position be marked on the plates and that each stud be manually aligned with the marks and attached. The result is that very little time is saved over traditional construction methods. U.S. Pat. Nos. 3,201,874 of Christy and 4,420,921 of Hardin show devices for holding two studs in a predetermined spaced relationship. While these devices are useful, they are not suited to holding a plurality of studs nor do they insure that the ends of the studs are aligned or that the top and bottom plates are correctly positioned to be attached to the studs. As a result, the top and bottom plates must still be manually positioned and the ends of the studs must be manually aligned for attachment to the plates. This is a tedious process and can be at least as time consuming as traditional methods.

Nowhere in the prior art of which Applicant is aware is there shown a means for aligning and spacing both studs and plates and holding these in proper position while being attached to each other.

SUMMARY OF THE INVENTION

The present invention is a lightweight portable framing aid in the form of a spacing gauge or jig for use in constructing a building such as a house. While it can be used to space floor joists, ceiling joists, and trusses quickly and conveniently, its primary function is as a jig or template for use in constructing wall sections of the type having several spaced vertical 2×4s attached at their ends to top and bottom plates which are also typically 2×4s. The invention comprises, generally, an elongated strip of material such as plastic that has several transverse slots or grooves for accepting the ends of studs and a longitudinal groove or slot for accepting a top or bottom plate. A pair of mortises are formed at one end of the strip and a pair of matching tenons are formed in the other end so that multiple framing aids may be attached together at their ends for constructing very long wall sections. Holes are formed in the framing aid through which nails or screws may be placed to firmly anchor the framing aid to a floor or work surface. In use, a pair of framing aids are aligned in a spaced opposing relationship and anchored to a floor. The spacing of the framing aid is such that when top and bottom plates are placed in the longitudinal grooves, the ends of studs placed in opposing transverse grooves rest against the plates. The plates may then be attached to the ends of the studs in a conventional manner such as with nails.

When used to space floor or ceiling joists, the framing aid may be placed across several joists and the positions of the joists adjusted to fit into the grooves. Not only does this assure proper spacing of the joists, the framing aid provides a walkway upon which a carpenter may stand and walk while attaching the joists to the structure of the building. As a further convenience, scales of measurement indicating the distance from an end of the framing aid and the running distance from the end of a first framing aid in a connected series may be marked on the surface of the framing aid.

Thus, a lightweight portable framing aid is provided that eliminates the need to measure and mark top and bottom plates for stud placement. Very little skill is required to use the framing aid, wall sections of any height may be constructed, and the studs of wall sections constructed using the framing aid are always precisely aligned. Assembling wall sections is extremely fast since the carpenter need only drop the plates and studs in their respective grooves and nail the plates to the end of the studs. When a wall section is completed, it is removed by simply lifting it out of the grooves. It may then be raised to its vertical position and attached to the floor or to other wall sections in the usual manner. The framing aid may also be used to space floor and ceiling joists in which case it also provides a walkboard upon which a carpenter may stand or walk.

DETAILED DESCRIPTION

Figure 1:
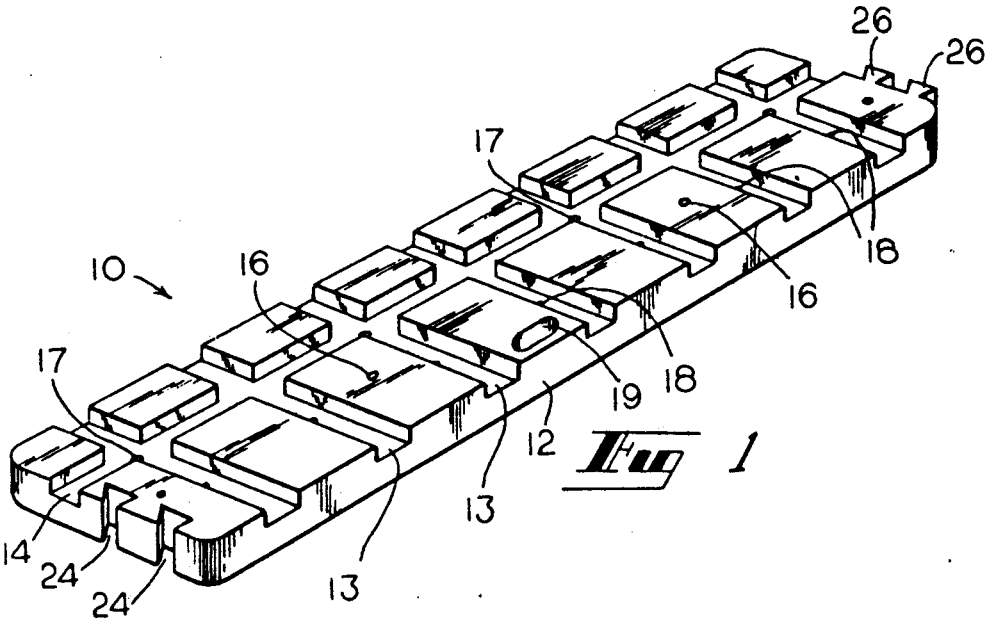
FIG. 1 is a perspective view of a preferred embodiment of the framing aid showing the transverse grooves and the longitudinal groove.

Referring now in more detail to the drawings, in which like numerals indicate like parts throughout the several views, FIG. 1 shows a framing aid 10 constructed in accordance with the principles of the invention. The framing aid 10 comprises an elongated strip 12 made of a strong, light material such as, for example, molded plastic that has formed therein several transverse slots or grooves 13. The slots 13 in the preferred embodiment are sized to accept the edges of two by four studs and have a spacing corresponding to that typically provided between wall studs. A longitudinal slot or groove 14 is formed in strip 12 and is sized to accept a top or bottom plate. The longitudinal groove 14 intersects each of the transverse grooves 13 at right angles.

Holes 16 through which anchoring screws or nails may be placed are formed in strip 12. In addition, holes 17 and 18 are formed within the longitudinal groove 14 and the transverse grooves 13 so that the studs and plates may be firmly attached to the framing aid if desired by placing nails or screws through these holes and into the studs or plates. A pair of mortises 24 are formed in one end of the strip 12 and a pair of matching tenons 26 are formed on the other end. It can be seen that multiple framing aids can be connected together at their ends by coupling the tenons of one framing aid with the mortises of another framing aid. Elongated hole 19 is formed along one edge of the strip 12 forming a handle by which the framing aid may be conveniently carried.

Figure 2:
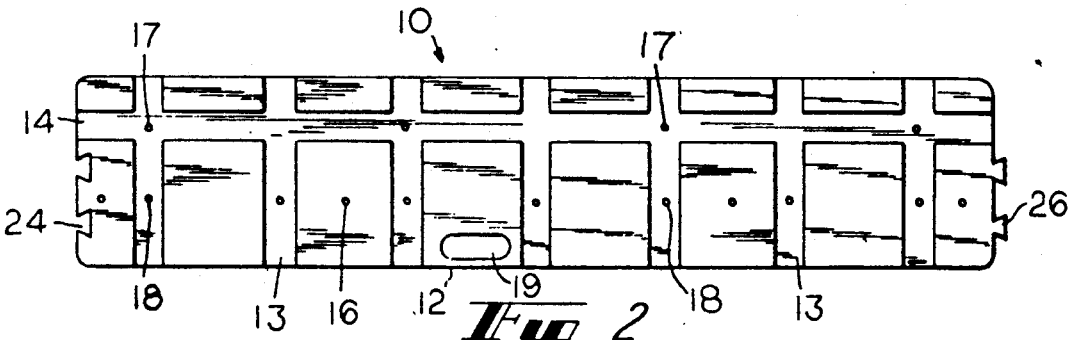
FIG. 2 is a plan view of the framing aid of FIG. 1.

FIG. 2 shows the framing aid 10 as it appears from the top. The right angular relationship between the transverse grooves 13 and the longitudinal groove 14 is clearly visible in this figure as is the placement of the anchor holes 16 and the attachment holes 18.

Figure 3:
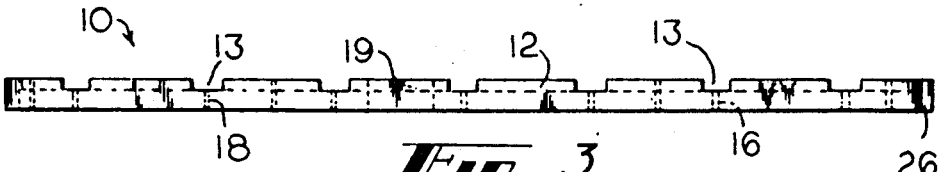
FIG. 3 is a side elevational view of the framing aid of FIG. 1.

FIG. 3 is a side elevation of the framing aid 10 showing the relative spacings of the transverse grooves 13.

Figure 4:
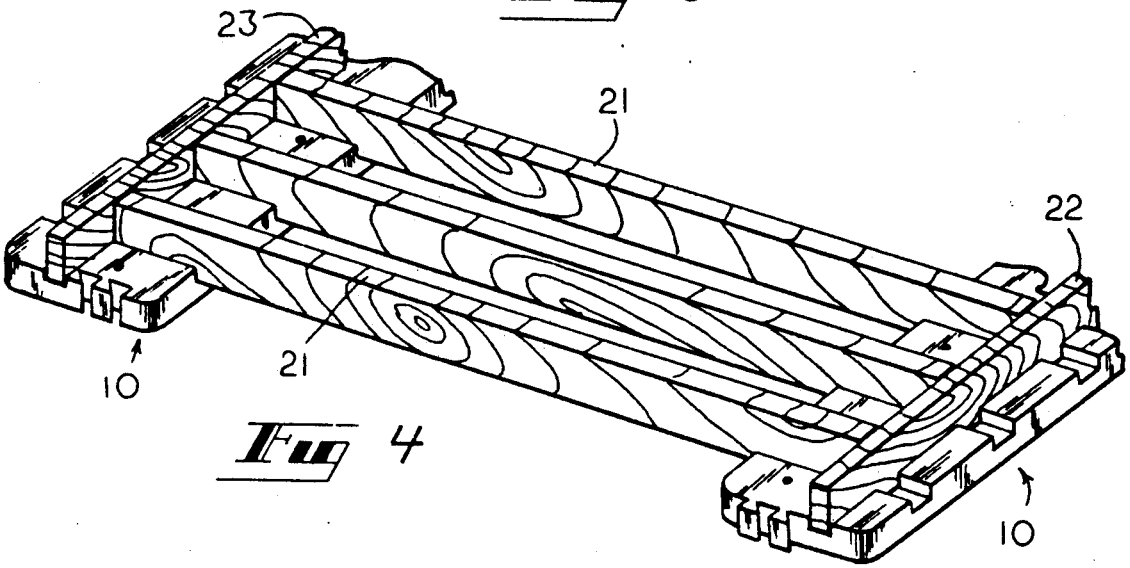
FIG. 4 is a perspective illustration of the preferred embodiment as it is used to construct wall sections.

FIG. 4 shows a pair of framing aids 10 as they appear when anchored to a floor in a spaced, parallel, opposing relationship for use in constructing a wall section. A bottom plate 22 is shown resting in the longitudinal groove of one of the framing aids and a top plate 23 is shown resting in the longitudinal groove of the other. Wall studs 21 rest in the opposing transverse grooves of the framing aids such that their ends are in contact with the top and bottom plates 23 and 22. It will be understood that while FIG. 4 shows only the ends of the framing aids and plates with only the first three studs in place it fully illustrates the principles of use of the framing aid.

Figure 5:
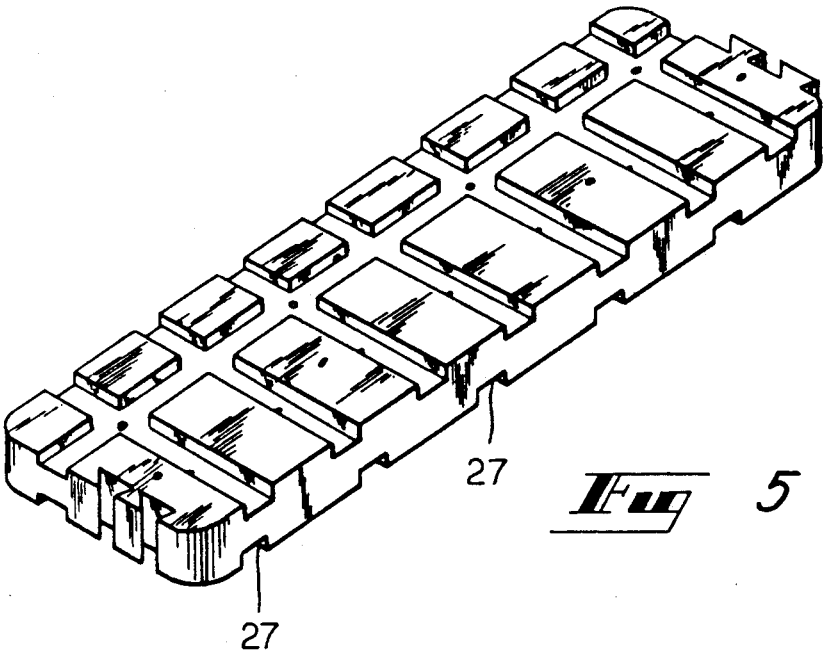
FIG. 5 is a perspective of an alternate embodiment having transverse grooves also formed in the bottom side of the framing aid.

FIG. 5 is an illustration of an alternate embodiment of the framing aid having transverse grooves 27 also formed in the bottom side of the elongated strip. These grooves are formed with spacings that may be different from the spacings between grooves on the top side of the strip. This allows a single framing aid to be used for multiple purposes, for example, the top side may be used to space wall studs as described and the bottom side used to space floor joists.

Figure 6:
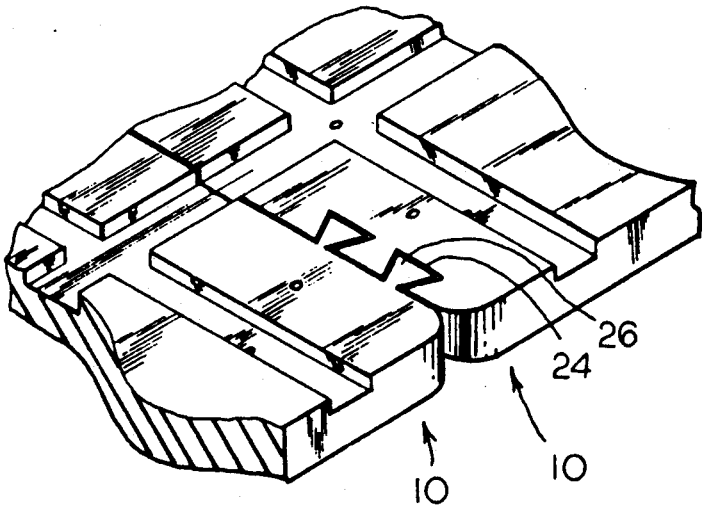
FIG. 6 is a perspective view illustrating the method of connecting multiple framing aids together at their ends.

FIG. 6 is a detail of two framing aids 10 connected together at their ends using mortise and tenons 24 and 26. In this configuration, the effective length of the framing aid is doubled such that long wall sections can be constructed in the same manner as short wall sections.

OPERATION

In using the framing aid 10 as a template or jig for building wall sections, a carpenter places a pair of the framing aids in a spaced parallel relationship on the floor such that the transverse grooves of one of the framing aids oppose the transverse grooves of the other. The framing aids may be properly spaced for the length of studs being used by placing a bottom plate 22 in the longitudinal groove of one framing aid, a top plate 23 in the longitudinal groove of the other framing aid, and a stud in each of the end transverse grooves. The spacing between the framing aids is then adjusted so that the ends of the two studs just contact the plates. In this way, no intricate and error prone measurement is required to properly position the framing aids.

Once the framing aids have been correctly positioned, they may be securely anchored to the floor or work surface by inserting nails or screws through the holes 16 and into the floor. With a pair of framing aids in this position, a wall section can be quickly, easily and accurately constructed by simply placing a top and bottom plate in the longitudinal grooves of the framing aids and dropping studs into opposing transverse slots. Nails can then be driven through the plates and into the ends of the studs in the conventional manner producing the completed wall section which can be easily removed from the framing aids by lifting it up. The wall section can then be attached to the floor or to other wall sections in the usual way.

It is thus seen that a framing aid is provided that eliminates the need for intricate and error prone measuring. In addition, no manual positioning of studs is required as studs and plates are each held in their proper positions for attachment by the framing aid. Wall sections can be quickly and accurately constructed by even the most unskilled carpenter. When not in use, the framing aids can be easily carried by one person and several framing aids fit conveniently in the bed of a truck.

The invention has been described above in the form of a preferred embodiment and a preferred application. The invention works equally well in other applications such as the correct positioning of floor joists, ceiling joists, and trusses. In these and other applications, spacings and angular relationships between grooves are, of course, modified to fit the application. A further modification to aid in placement of framing members in the jig might include sloped guides formed in the top side of the elongated member for directing studs and joists to their proper seated positions within their corresponding grooves. It is therefore clear that many modifications, additions, and deletions may be made to the invention without departing from the spirit and scope of the invention as set forth in the claims.

I claim:

1. A spacing jig adapted to aid in the spacing of wall studs and floor joists, said spacing jig comprising:

an elongated member having a first and second end and a top and bottom side;

a longitudinally extending slot formed in said top side laterally offset from the center line of said elongated member and extending substantially parallel thereto;

a plurality of transverse slots formed in said top side extending across said elongated member and intersecting said longitudinally slot at right angles with the spacing between adjacent transverse slots corresponding to spacings between wall studs;

means for releasably coupling said spacing jig to other spacing jigs of the same construction at the ends thereof, said coupling means comprising a pair of substantially triangular tenons formed on said first end of said elongated member and a pair of substantially triangular mortises formed in said second end of said elongated member, said pairs of mortises and tenons being laterally offset from the longitudinal center of said elongated member in a direction opposite to the direction of offset of said elongated slot;

means for anchoring said spacing jig in a fixed position on a supporting surface; and a plurality of transverse slots formed in said bottom side of said elongated member with the spacings between adjacent slots formed in the bottom side corresponding to the spacing between floor joists.

* * * * *